US008915415B2

(12) United States Patent
Yokochi

(10) Patent No.: US 8,915,415 B2
(45) Date of Patent: Dec. 23, 2014

(54) GAS COMBUSTION TYPE STRIKING MACHINE

(75) Inventor: Yasushi Yokochi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 693 days.

(21) Appl. No.: 13/190,569

(22) Filed: Jul. 26, 2011

(65) Prior Publication Data

US 2012/0037681 A1 Feb. 16, 2012

(30) Foreign Application Priority Data

Aug. 12, 2010 (JP) ..... 2010-181011

(51) Int. Cl.
*B25C 1/08* (2006.01)
*B25C 1/00* (2006.01)

(52) U.S. Cl.
CPC .. *B25C 1/08* (2013.01); *B25C 1/008* (2013.01)
USPC ..... 227/10; 227/130

(58) Field of Classification Search
CPC ..... B25C 1/008; B25C 1/046; B25C 1/043; B25C 1/08; B25C 1/085
USPC ..... 227/9–11, 130
See application file for complete search history.

(56) References Cited

U.S. PATENT DOCUMENTS

| | | | | |
|---|---|---|---|---|
| 4,629,106 | A * | 12/1986 | Howard et al. | 227/8 |
| 5,083,694 | A * | 1/1992 | Lemos | 227/8 |
| 5,193,730 | A * | 3/1993 | Tanaka et al. | 227/8 |
| 5,862,969 | A * | 1/1999 | Lee | 227/8 |
| 5,909,836 | A | 6/1999 | Shkolnikov et al. | |
| 6,145,724 | A | 11/2000 | Shkolnikov et al. | |
| 7,210,431 | B2 | 5/2007 | Nishikawa et al. | |
| 7,308,995 | B2 * | 12/2007 | Uchiyama et al. | 227/8 |
| 7,931,181 | B2 * | 4/2011 | Akiba | 227/10 |
| 2006/0144889 | A1 | 7/2006 | Nishikawa et al. | |
| 2007/0194075 | A1 | 8/2007 | Tanaka et al. | |
| 2010/0176177 | A1 * | 7/2010 | Tanaka | 227/10 |

FOREIGN PATENT DOCUMENTS

| | | | |
|---|---|---|---|
| CN | 1274633 | A | 11/2000 |
| CN | 1929957 | A | 3/2007 |
| EP | 203620 | A1 | 3/1986 |
| JP | UM-A-H05-53873 | | 7/1993 |
| JP | A-H05-261678 | | 10/1993 |
| JP | UM-Y-H06-47665 | | 12/1994 |
| JP | A 2006-167901 | | 6/2006 |
| JP | 2008-260094 | | 10/2008 |
| JP | 2008260094 | A * | 10/2008 |

* cited by examiner

*Primary Examiner* — Andrew M Tecco
(74) *Attorney, Agent, or Firm* — Drinker Biddle & Reath LLP

(57) ABSTRACT

In a gas combustion type striking machine, a combustion chamber is opened and closed by moving a movable sleeve in a vertical direction. A safety lever is attached to a trigger, and a switch is switched by being pressed by a switch lever arranged to be engageable with the safety lever. A hold member which is engageable with the movable sleeve is rotatably connected to the trigger. A shaft supporting a base end of the hold member positions between a shaft supporting the switch lever and a cylinder in a right-left direction which is perpendicular to the vertical direction.

10 Claims, 17 Drawing Sheets

GAS COMBUSTION TYPE STRIKING MACHINE

BACKGROUND OF THE INVENTION

1. Field of the Invention

The present invention relates to a gas combustion type striking machine for driving a nail into concrete or lumber using a combustion pressure of fuel gas.

2. Related Art

In general, in a gas combustion type striking machine, a piston is provided vertically slidably within a cylinder disposed within a body. A cylindrical-shaped movable sleeve is vertically slidably fitted with an upper outside portion of the cylinder. The movable sleeve is energized downwardly by a spring in such a manner that it is normally situated at its lower position. When the machine is put into its nailing operation, the movable sleeve is moved upward against the spring and is thereby contacted with a cylinder head disposed upwardly of the cylinder, so as to form a closed combustion chamber. Combustion gas existing within the combustion chamber is ignited and combusted explosively to thereby actuate a driver together with the piston. Specifically, using the driver connected to the lower surface side of the piston, a nail supplied to a nose portion disposed downwardly of the cylinder is struck and driven out from the nose portion.

While a trigger for starting the nailing operation of the machine is being pulled, the movable sleeve must be held at its upper position to thereby form a closed combustion chamber. US2010/0176177 discloses a structure in which the movable sleeve is received by a cam made of synthetic resin through a lock-out bar (hold member). The cam is slidably provided in the body and is used to hold the movable sleeve in a combustion chamber sealed state. In order to prevent an activation of the machine in a case that the trigger is pulled first and then the machine is pressed to a workpiece, the cam embraces the lock-out bar to thereby prevent the movable sleeve against movement.

In the above structure, the cam fulfills an important function. However, there is a possibility the cam is deformed due to a heat generated owing to a combustion of mixed gas within the combustion chamber and/or a sliding surface of the cam is damaged by dust or sand generated in a working site.

Also, in a case that a leading end of the machine is struck strongly against the workpiece, the cam can be deformed or damaged.

In view of the above, JP-A-2008-260094 discloses a mechanism in which the lock-out bar is connected to the trigger without using a synthetic resin cam. According to this technology, it is not necessary to pay attention to an influence of heat generated due to the combustion of gas, but a space of the machine corresponding to the cam can be saved to thereby be able to reduce a whole height of the machine.

However, in the structure in which the lock-out bar is connected to the trigger, since a switch mechanism cannot be located in a vicinity of an upper portion of the trigger because the lock-out bar provides an obstacle. Thus, a dead space is generated in the upper portion of the trigger, whereby the space cannot be used effectively.

SUMMARY OF THE INVENTION

One or more embodiments the invention provide a gas combustion type striking machine which can hold a movable sleeve without using a cam, has a good weight balance to provide a good workability for preventing user's tiredness, and also can use an upper portion of a trigger effectively.

According to one or more embodiments, in a gas combustion type striking machine, a combustion chamber 7 may be opened and closed by moving a movable sleeve 6 in a vertical direction. A safety lever 23 may be attached to a trigger 10, and a switch 26 may be switched by being pressed by a switch lever 25 arranged to be engageable with the safety lever 23. A hold member 43 which is engageable with the movable sleeve 6 may be rotatably connected to the trigger 10. A shaft 100 supporting a base end 43B of the hold member 23 may position between a shaft 24 supporting the switch lever 25 and a cylinder 4 in a right-left direction which is perpendicular to the vertical direction.

Other aspects and advantages of the invention will be apparent from the following description and the appended claims.

DETAILED DESCRIPTION OF EXEMPLARY EMBODIMENT

The description will be given hereinbelow on the basis of exemplary embodiments and a modification thereof with reference to the drawings. Further, the exemplary embodiments and the modification are not intended to limit the invention but to serve as examples thereof, and all features or combinations thereof described in the exemplary embodiments and the modification are not always essential to the invention.

First Exemplary Embodiment

Figure 1:
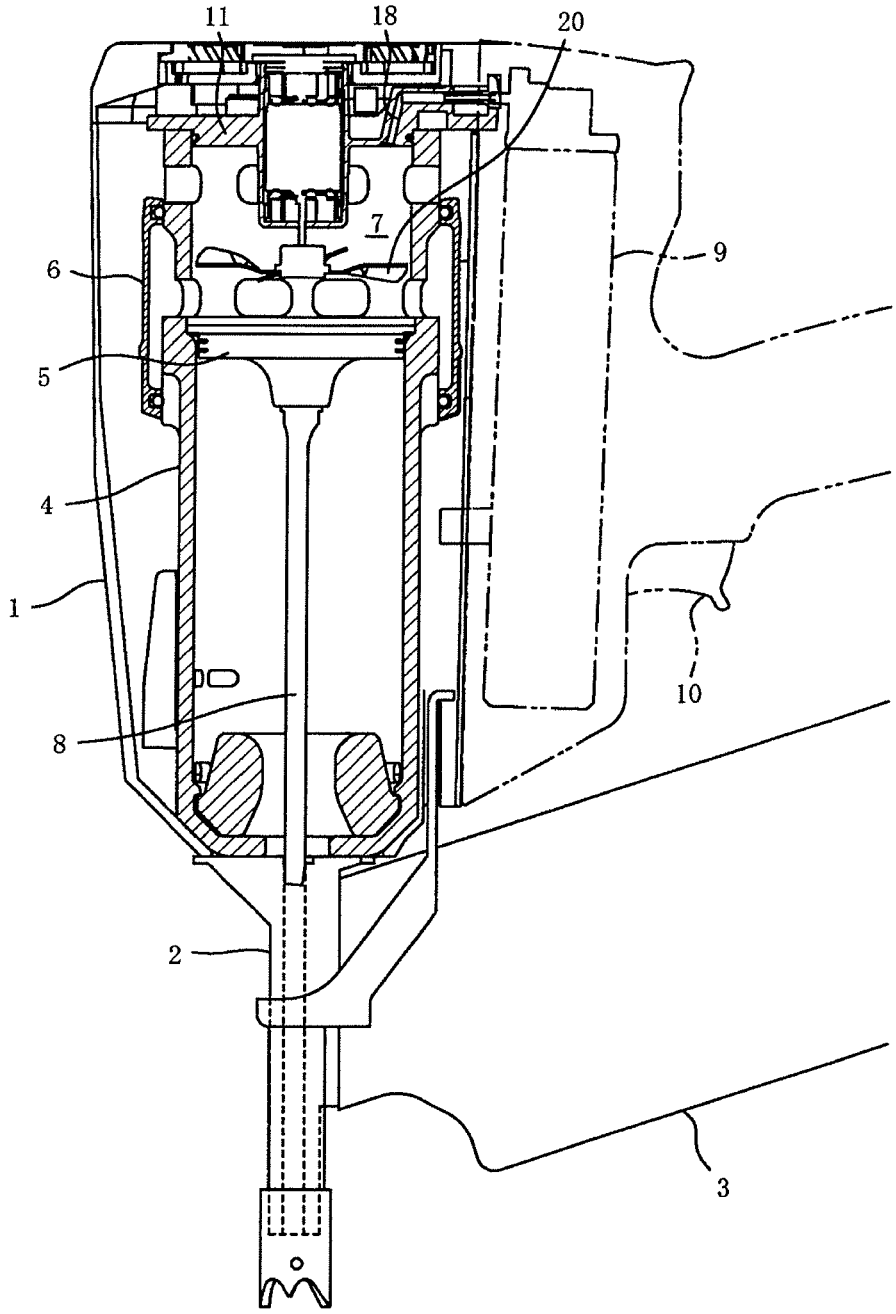
FIG. 1 is an explanatory section view of a basic structure of a gas combustion type striking machine according to a first exemplary embodiment.
Figure 2:
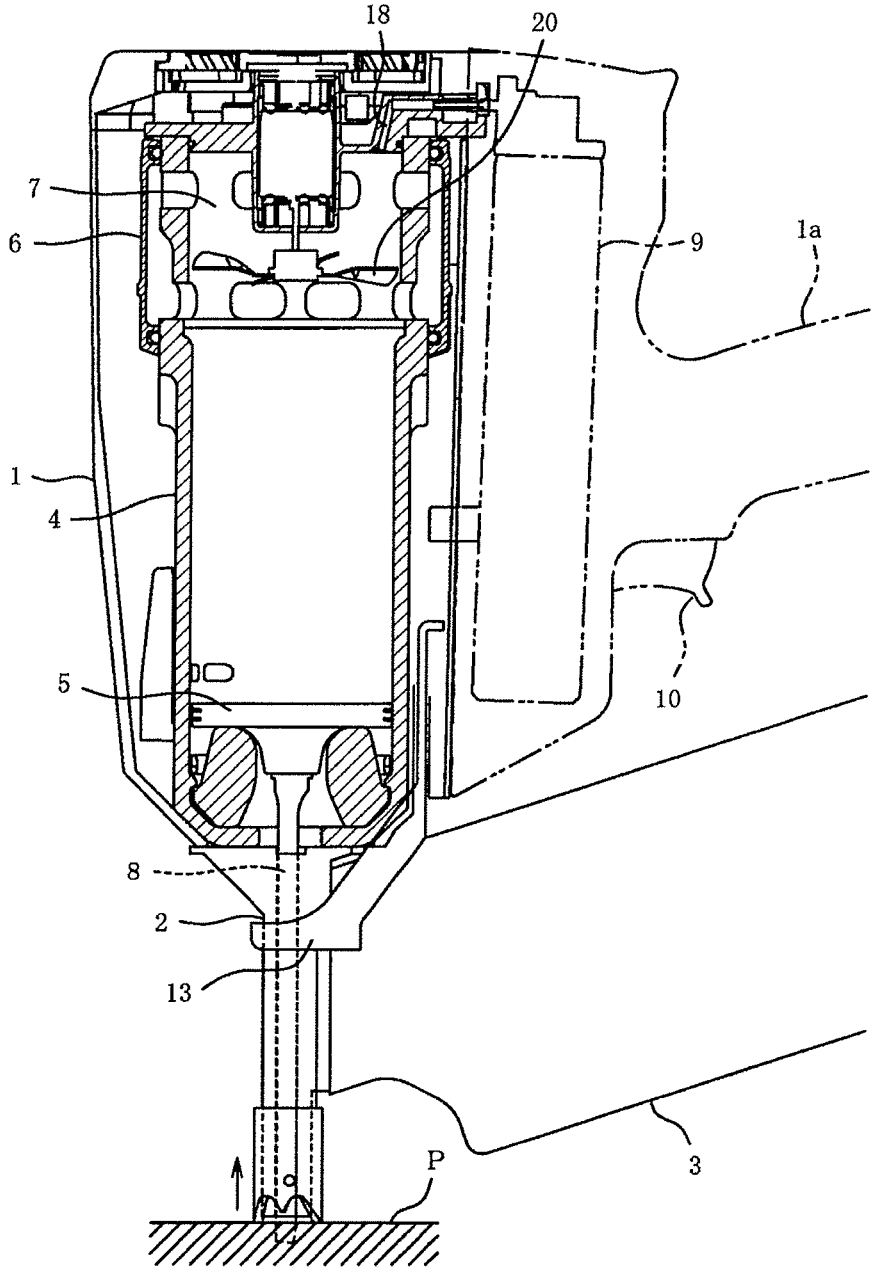
FIG. 2 is a partially sectional explanatory view of an operating state of the gas combustion type striking machine.

FIGS. 1 and 2 are respectively section views of a basic structure of a gas combustion type striking machine of a first exemplary embodiment, in which reference numeral 1 designates the body of the combustion type striking machine. In the interior portion of the body 1, there is provided a striking mechanism and, downwardly of the body 1, there is disposed a nose portion 2 from which a nail can be driven. On the rear portion of the striking mechanism, there is mounted a gas can 9 filled with fuel gas which is produced by liquefying combustible gas. Also, to the body 1, there are connected a grip 1*a* and a magazine 3, while the magazine 3 is structured such that it opens on the nose portion 2 and can supply a nail to the nose portion 2.

Referring to the structure of the striking mechanism, within a cylinder 4 disposed within the body 1, there is slidably provided a piston 5; and, within a combustion chamber 7 so closed formed as shown in FIG. 2 by a movable sleeve 6 provided on the upper portion of the cylinder, combustible mixed gas is ignited and is combusted explosively, and the piston 5 is driven by this high-pressure combustion gas to actuate a driver 8 integrally connected to the piston 5, thereby striking a nail (not shown) existing within the nose portion 2. Reference numeral 10 designates a trigger which is used to start the operation of the striking machine.

Here, in a cylinder head 11, there are provided an injection nozzle 18 communicating with the gas can 9, an ignition plug (not shown) used to ignite and combust the mixed gas, and a rotary fan 20 used to stir and mix combustible gas injected into the combustion chamber 7 by the injection nozzle 18 with the air existing within the combustion chamber 7 to produce mixed gas having a given air/fuel rate.

The combustion chamber 7 is defined by the upper end face of the piston 5 and the ring-shaped movable sleeve 6 interposed between the cylinder 4 and a cylinder head 11 provided in the interior portion of the upper portion of the body 1. When the movable sleeve 6, as shown in FIG. 2, is moved upwardly toward the cylinder head 11 for sealing, the combustion chamber 7 is formed in a sealed or closed manner; whereas, when the movable sleeve 6 is moved downwardly as shown in FIG. 1, the upper portion of the combustion chamber 7 can be opened to the air.

Next, the upward and downward movements of the movable sleeve 6 are carried out in the following manner. That is, on the lower end of the movable sleeve 6, there is mounted a U-shaped chamber arm 12, while the lower end of the chamber arm 12 is so disposed as to be engageable with the receiving portion 15 of the lower portion of a guide block 14 provided upwardly of a contact arm (contact member) 13. The contact arm 13 is constituted of multiple members connected together. And, the contact arm 13 is structured such that it can slide freely in the upward and downward nail driving directions along the nose portion 2 and, when the lower end thereof is pressed against the workpiece, it can move relatively upwardly with respect to the nose portion 2. The upper portion of the contact arm 13 is structured such that it can slide in the vertical direction along a partition wall 17 between the storage portion 16 of a gas can (not shown) filled with fuel gas and cylinder 4.

Here, the movable sleeve 6 is normally energized downwardly by a spring (not shown). Therefore, the contact arm 13 is also so energized as to project from the lower end of the nose portion 2.

The above striking machine includes: a slide arm 21 movable vertically according to the operation of the contact arm 13; a safety lever 23 pivotally supported on a shaft 22 which is provided on the substantially central portion of the side wall of the trigger 10 and can be engaged with the slide arm 21 through a torsion coil spring 36 (which will be discussed later); a trigger switch lever 25 provided on the body 1, specifically, pivotally supported on a shaft 24 provided on the base portion of the grip 1*a* so as to be engageable with the safety lever 23; and, a microswitch 26 which, when it is pressed by the trigger switch lever 25, can ignite the above ignition plug. The trigger switch lever 25 is rotatable between an OFF position where the trigger switch lever does not engage with the microswitch 26 and an ON position to engage with the microswitch 26 so as to activate the microswitch 26.

The slide arm 21 is so disposed as to stride over the gas can stored within a gas can storage portion 16 and can be moved vertically along the partition wall 17 between the gas can storage portion 16 and cylinder 4. An engaging piece 27 is provided on and projected from the front portion of the slide arm 21 and, specifically, the engaging piece 27 penetrates through an opening 28 formed in the partition wall 17 and projects toward the cylinder 4. Also, an engaging arm 30 is provided on and projected from the rear portion of the slide arm 21, while the leading end portion of the engaging arm 30 penetrates through an opening 31 formed in the rear wall of the body 1 and projects outwardly therefrom. And, the engaging piece 27 is disposed upwardly of the guide block 14 provided on the upper portion of the contact arm 13 and, halfway in the upward movement of the contact arm 13, the engaging piece 27 can be engaged with the guide block 14. Also, the leading end portion of the engaging arm 30 projects toward the trigger 10.

Next, one end of the trigger 10 is pivotally supported on a support shaft 32 interposed between the trigger 10 and grip 1*a*.

Figure 3:
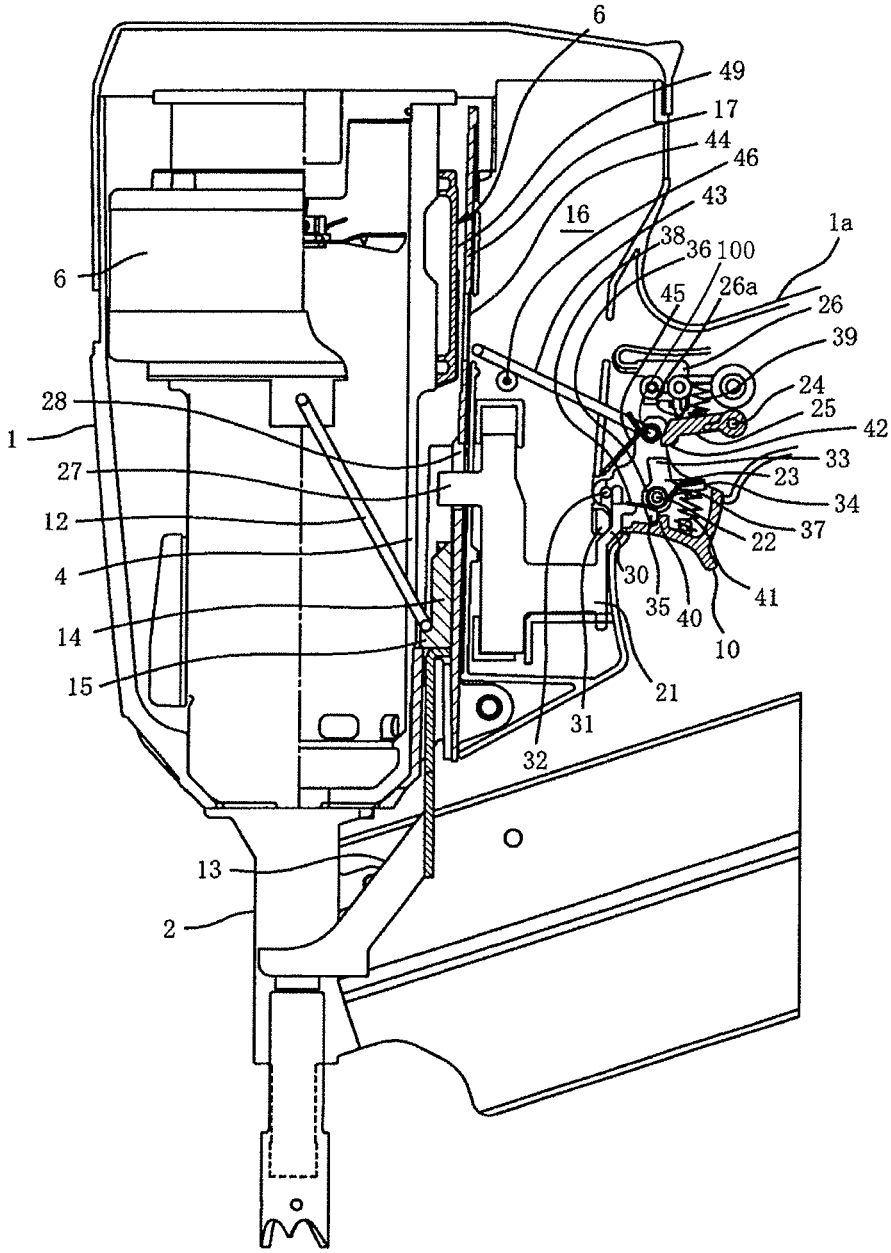
FIG. 3 is a partially longitudinal section view a mechanism and a neighboring portion of the mechanism of the first exemplary embodiment.

The safety lever 23 includes a lever portion 33, a spring receiving piece 34 and an engaging piece 35 which are respectively extended radially from the central portion of the safety lever 23. The lever portion 33 is so disposed as to face upwardly, the spring receiving piece 34 extends substantially horizontally, and the engaging piece 35 is so disposed as to face downwardly. And, on the spring receiving piece 34, there is mounted one end 37 of the torsion coil spring 36 mounted on the shaft 22, while the engaging piece 35 can be engaged with a projecting portion 40 which projects upwardly from the lower wall of the trigger 10. The other end 38 of the torsion coil spring 36 can be engaged with the upper end of the engaging arm 30 of the slide arm 21. Also, between the spring receiving piece 34 and the lower wall of the trigger 10, there is interposed a coil spring 41. Therefore, the safety lever 23 is so energized by the coil spring 41 as to be rotatable counterclockwise in a direction toward a first position from a second position. The two ends 37 and 38 of the torsion coil spring 36 are held at the same angle due to the elasticity thereof. Therefore, while the safety lever 23 is held in the wait state, the engaging piece 35 is energized by the coil spring 41 and is thereby engaged with the projecting portion 40 of the trigger 10. When the slide arm 21 moves upwardly, the safety lever 23 is pushed up by the engaging arm 30 and is rotated to the right by the torsion coil spring 36 against the spring force of the coil spring 41, whereas, as shown in FIG. 3, when the slide arm 21 moves downwardly and the engaging arm 30 parts away from the torsion coil spring 36, the safety lever 23 is rotated to the left by the spring force of the coil spring 41.

Upwardly of the trigger 10, there is disposed the microswitch 26 through the trigger switch lever 25.

The leading end of the trigger switch lever 25 is structured to be movable between two positions: specifically, one position at which, when the trigger switch lever 25 rotates about the shaft 24, it can press against the contact 26*a* of the microswitch 26 to turn on the microswitch 26; and, the other position at which it parts away from the contact 26*a*. Also, the trigger switch lever 25, in the wait state thereof, is held by a coil spring 39 in a substantially horizontal state in which it is separated from the microswitch 26. This eliminates the possibility that the trigger switch lever 25 can be swung due to inertia, which can be possibly generated when the striking machine is struck against a certain member, to thereby press against the microswitch 26.

The trigger switch lever 25, when the trigger 10 is pulled and rotated upwardly, can be engaged with the leading end of the safety lever 23 and, when the trigger 10 is further pressed and rotated, can be pressed against the microswitch 26. However, in the wait state, even when the trigger switch lever 25 is rotated, the lever portion 33 passes the leading end 42 of the trigger switch lever 25, so that the trigger switch lever 25 cannot press against the microswitch 26.

Further, to the upper portion on the rotation center side of the trigger 10, there is rotatably connected a metal-made lock-out bar 43 serving as a hold member. This lock-out bar 43 is also so disposed as not to interfere with the gas can 9, while the lock-out bar 43 penetrates through an opening 44 formed in the partition wall 17 and projects toward the cylinder 4. And, the lock-out bar 43 is normally energized downwardly by a torsion coil spring 45 and is supported on a projecting shaft 46 which projects inwardly of the gas can storage portion 16. The leading end of the lock-out bar 43, in its wait state, is held at a position corresponding to the side surface 49 of the movable sleeve 6. However, as will be described later, in the case that the trigger 10 is rotated while the movable sleeve 6 stands in its wait state, the leading end 43L of the lock-out bar 43 is engaged with the side surface 49 of the movable sleeve 6; and, in the case that the trigger 10 is rotated when the movable sleeve 6 moves upwardly, the leading end of the lock-out bar 43 is so moved as to be engageable with the lower surface 47 of the movable sleeve 6.

Here, since the torsion coil spring 45 is engaged with the lock-out bar 43 and trigger 10, the trigger 10 is also normally energized such that it is moved to its lower wait position.

As described in the above, according to the first exemplary embodiment, the gas combustion type striking machine may include: the body 1; the cylinder 4 arranged in the body 1; the piston 5 arranged slidably in the vertical direction in the cylinder 4; the movable sleeve 6 arranged in the upper portion of the cylinder 4; the combustion chamber 7 which is opened and closed by moving the movable sleeve 6 in the vertical direction; the nose portion 2 arranged in the lower side of the body 1 and from which the nail is driven out; the contact member 13 projecting from the nose portion 2 to be slidable in the vertical direction and configured to upwardly move with respect to the body 1 by being pressed against the workpiece so as to move the movable sleeve 6 in the closing direction to close the combustion chamber 7; the trigger 10; the safety lever 23 attached to the trigger 10 and arranged to be movably linked to the movement of the contact member 13; the switch lever 25 arranged to be engageable with the safety lever 23; the switch 26 configured to be switched by being pressed by the switch lever 25; and the hold member 43 rotatably connected to the trigger 10 and arranged to be engageable with the movable sleeve 6.

The safety lever 23 may be pivotally supported on the shaft 22 fixed on the trigger 10 and rotatable between the first position and the second position with respect to the trigger 10. The switch lever 25 may be pivotally supported on the shaft 24 fixed on the body 1 and rotatable between the ON position where the switch 26 is switched on and the OFF position where the switch 26 is switched off. The switch 26 may be fixed on the body 1. The hold member 43 may have the base end 43B pivotally supported on the shaft 100 fixed on the trigger 10 and the leading end 43L which is engageable with the movable sleeve 6, and the intermediate portion of the hold member 43 between the base end 43B and the leading end 43L is supported on the projecting shaft 46 fixed on the body 1. The shaft 100 supporting the base end 43B may position between the shaft 24 supporting the switch lever 25 and the cylinder 4 in the right-left direction which is perpendicular to the vertical direction.

The leading end 43L of the hold member 43 may be arranged in the position to engage with the lower surface 47 of the movable sleeve 6 so as to hold the combustion chamber 7 in the closed state, in the condition that the movable sleeve 6 is in the upper position to close the combustion chamber and that the trigger 10 is pulled.

The combustion type striking machine may include the slide arm 21 arranged to be slidable in the vertical direction with respect to the body 1 and the engaging piece 27 formed on the front side of the slide arm 21 and positioned in the upper side of the upper portion 14 of the contact member 13. The torsion coil spring 36 may be attached to the shaft 22 on the trigger 10 where the safety lever 23 is supported, the one end 37 of the torsion coil spring 36 may be attached to the spring receiving piece 34 formed on the safety lever 23, and the other end 38 of the torsion coil spring 36 may be arranged to be engageable with the upper end of the engaging arm 30 formed on the rear portion of the slide arm 21. The safety lever 23 may be urged toward the first position by the spring 41. The engaging piece 27 of the slide arm 21 may be arranged in the position to engage with the upper portion 14 of the contact member 13 so as to upwardly move the slide arm 21, in the condition that the contact member 13 is pressed against the workpiece and upwardly moves. The other end 38 of the torsion coil spring 36 may be arranged in the position to engage with the upper end of the engaging arm 30 so as to rotate the safety lever 23 toward the second position, in the condition that the slide arm 21 upwardly moves. The lever portion 33 formed on the safety lever 23 may be arranged in the position to engage with the switch lever 25 so as to rotate the switch lever 25 from the OFF position to the ON position in the condition that the safety lever 23 is in the second position and that the trigger 10 is pulled, and not to engage with the switch lever 25 in the condition that the safety lever 23 is in the first position and that the trigger 10 is pulled.

The engaging arm 30 of the slide arm 21 may be arranged in the position to make the other end 38 of the torsion coil spring 36 to downwardly move so as to rotate the safety lever 23 toward the first position by the spring 41 without the engagement of the lever portion 33 of the safety lever 23 with the switch lever 23, in the condition that the leading end 43L of the hold member 43 engages with the lower surface 47 of the movable sleeve 6 to hold the closed state of the combustion chamber 7 and that the pressing action of the contact member 13 against the workpiece is released to make the slide arm 21 downwardly move with respect to the body 1.

The leading end 43L of the hold member 43 may be arranged in the position to engage with the side surface of the movable sleeve 6 in the condition that the contact member 13 is in its bottom dead center and the trigger 10 is pulled.

The lever portion 33 of the safety lever 23 may be arranged in the position to passes the switch lever 25 to release the engagement between the lever portion 33 and the switch lever 25, in the condition that the switch lever 25 presses the switch 26 to switch ON by the pulling operation of the trigger 10 and that the trigger is further pulled thereafter.

The contact area "a" in which the safety lever 23 and switch lever 25 are in contact with each other as ranging from the switch-on state generated when the trigger 10 is operated after the contact member 13 is pressed against the workpiece P to thereby press the safety lever 23 against the switch lever 25 to the switch-off state generated when the safety lever 23 passes the switch lever 25 may be set to correspond to the length in which the safety lever 23 and switch lever 25 are in contact with each other while the contact arm 13 is moving from its substantially middle position to its top dead center.

The trigger 10 may be pivotally supported on the shaft 32 fixed on the body 1.

The lever portion 33 and the spring receiving piece 34 may be respectively formed to radially extend on the safety lever 23.

Next, description will be given below of the operation of the striking machine.

Figure 4:
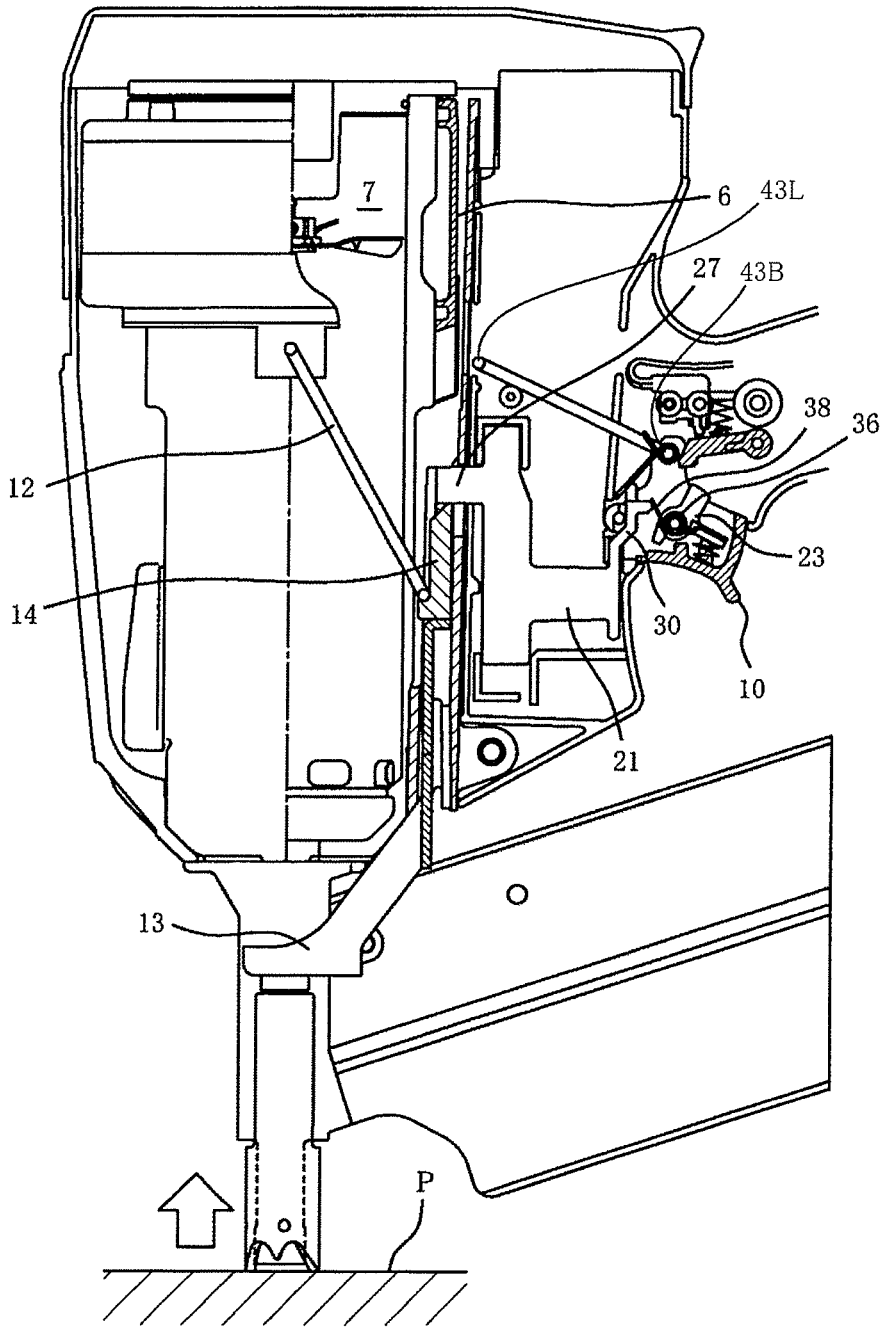
FIG. 4 is a partially longitudinal section view of a striking machine, showing a state thereof in which a contact member is pressed against a workpiece.

When driving a nail, firstly, as shown in FIG. 4, the lower end of the contact arm 13 is pressed against a workpiece P. Thus, since the chamber arm 12, together with the contact arm 13, is also moved relatively upwardly with respect to the nose portion 2, the movable sleeve 6 is pushed up, thereby forming a closed combustion chamber 7. When the combustion chamber 7 is closed, as described above, combustible gas is injected from the injection nozzle into the combustion chamber 7 and a motor is driven to rotate the rotary fan 20, thereby stirring and mixing together the combustible gas and the air.

Here, halfway in the upward movement of the contact arm 13, the guide block 14 of the upper portion of the contact arm 13 is engaged with the engaging piece 27 of the slide arm 21, whereby the slide arm 21 is moved upwardly. Thus, the engaging arm 30 of the slide arm 21 is engaged with and is pushed up the end portion 38 of the torsion coil spring 36, whereby the safety lever 23 is rotated to the right.

Figure 5:
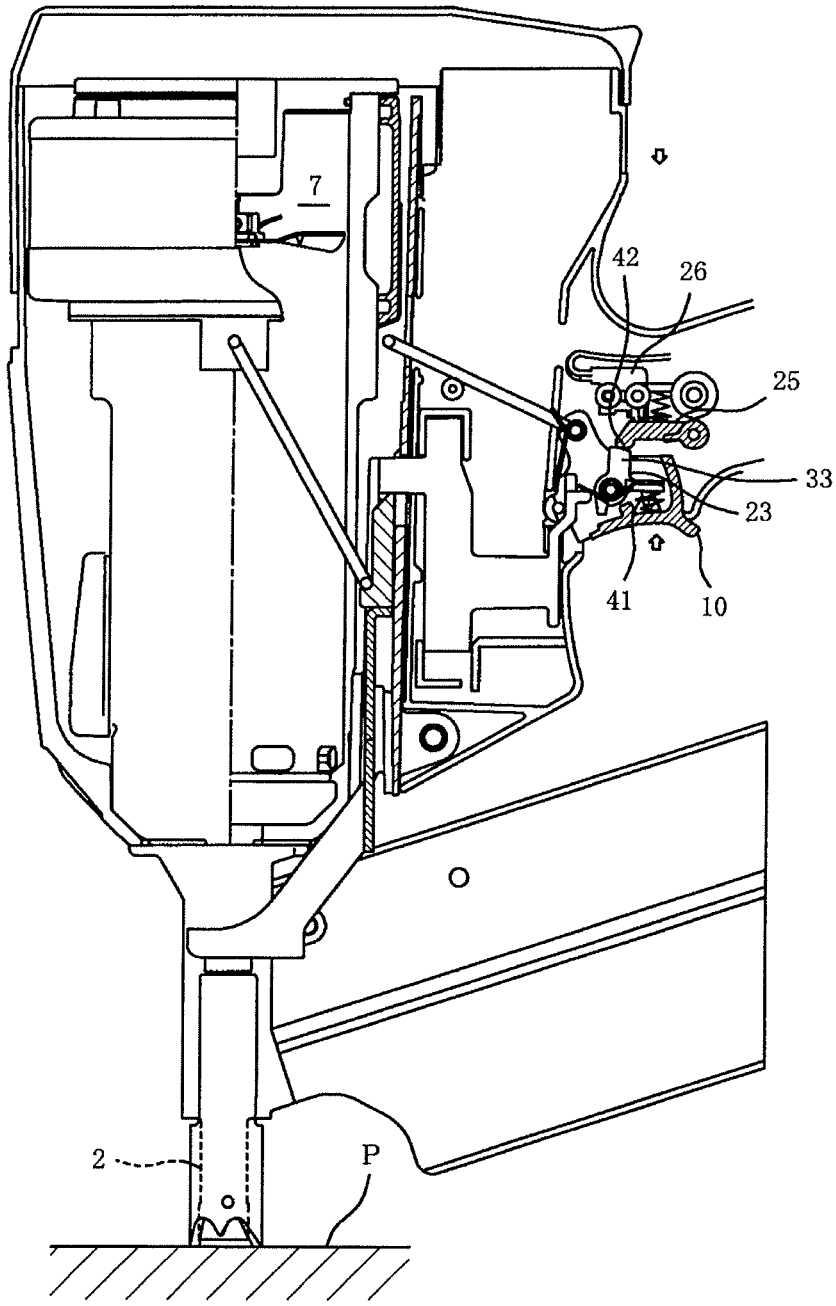
FIG. 5 is a partially longitudinal section view of the striking machine, showing a state in which a trigger is operated to start an operation of the striking machine.

In this state, when, as shown in FIG. 5, the trigger 10 is pulled up and rotated, just before the rotating end thereof, the leading end of the lever portion 33 of the safety lever 23 is engaged with the lower surface of the leading end 42 of the trigger switch lever 25 to push it up, whereby the trigger switch lever 25 is rotated upwardly and is pressed against the microswitch 26. As a result of this, since a switch included in a circuit connected to the ignition plug is turned on, mixed gas within the combustion chamber 7 is ignited, combusted and expanded explosively. The pressure of this combustion gas, as described above, is applied to the upper surface of the piston 5 to impactively drive the piston 5 downwardly, whereby the piston 5 strikes the leading one of nails within the magazine 3 respectively supplied into the nose portion 2 to thereby drive it into the workpiece P.

Figure 6:
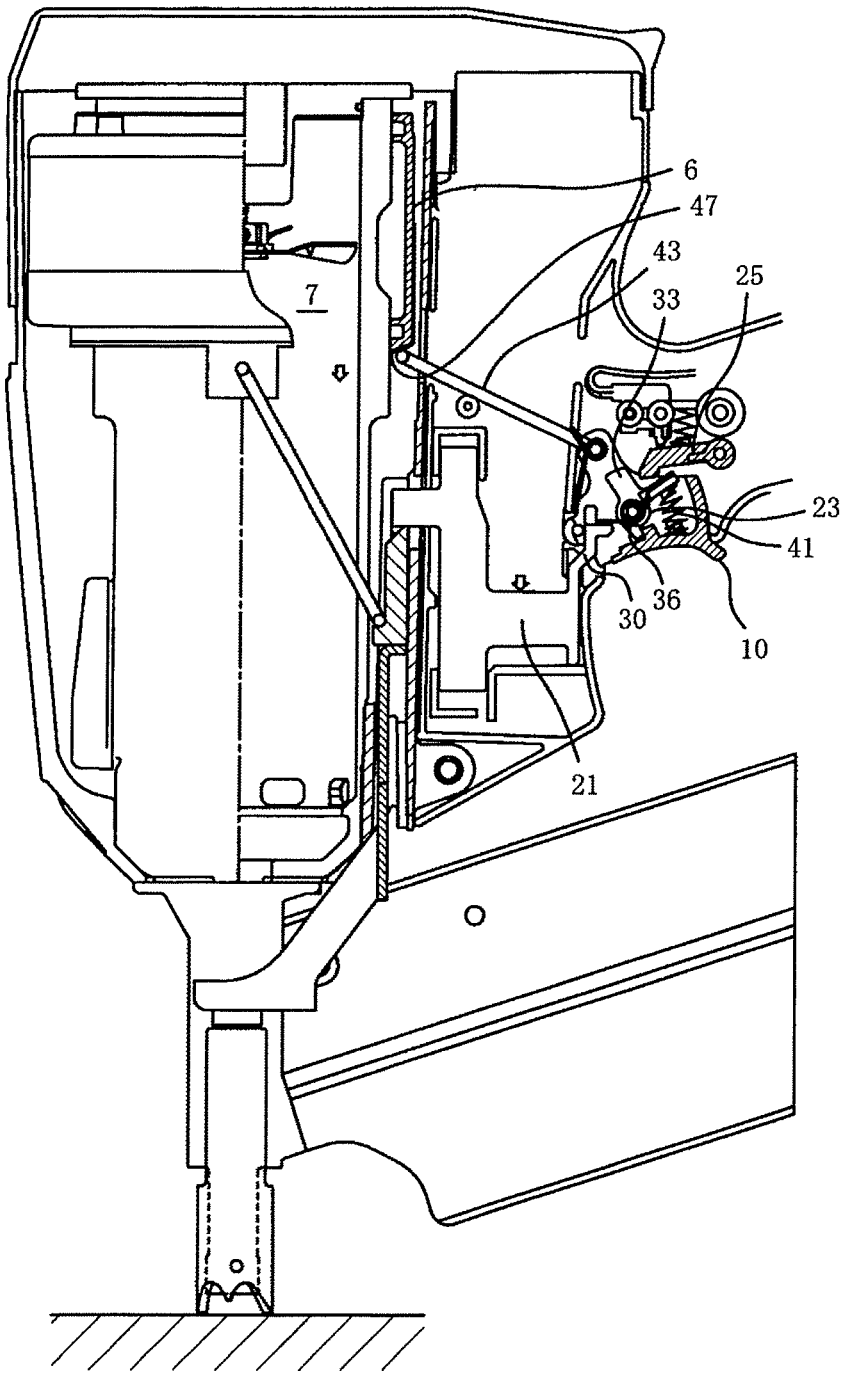
FIG. 6 is a partially longitudinal section view of the striking machine, showing a state in which the trigger is pulled at a full stroke.

Here, when the trigger 10 is pulled up by full stroke, as shown in FIG. 6, the safety lever 23 is moved further upwardly and thus the slide arm 21 is moved relatively downwardly, whereby the end portion of the torsion coil spring 36 is separated from the engaging arm 30 of the slide arm 21. Due to this, the safety lever 23 is rotated to the left by the spring force of the coil spring 41 and thus it passes the leading end of the trigger switch lever 25. Also, due to the rotation of the trigger 10, the lock-out bar 43 is moved downwardly of the lower surface 47 of the movable sleeve 6 which has moved upwardly. And, in the case that the whole of the driving machine is lifted up due to the reaction that is generated when driving the nail, the movable sleeve 6 is relatively lowered from the top dead center thereof. However, when the trigger 10 is rotated, the end portion of the lock-out bar 43 sticks out downwardly of the lower surface 47 of the movable sleeve 6, whereby the lower surface 47 of the movable sleeve 6 having moved downwardly is engaged with the sticking-out end portion of the lock-out bar 43, thereby preventing the movable sleeve 6 from lowering any further. Therefore, the combustion chamber 7 can be held in a closed state.

When the nailing operation is completed, since the temperature within the combustion chamber 7 lowers suddenly, a space existing upwardly of the piston 5 and enlarged up to the cylinder 4 in FIG. 2 becomes negative in pressure. Thus, the piston 5 is caused to return to the top dead center due to a difference between the pressure of the space and the pressure of the atmospheric pressure coming from below. And, the striking machine is pulled up to separate the nose portion 2 from the workpiece, and the trigger 10 is released and is rotated downwardly, whereby the lock-out bar 43 is moved apart from the movable sleeve 6. Thus, due to the energizing force of the spring, the movable sleeve 6 and contact arm 13 are moved downwardly to thereby open the combustion chamber 7, the combustion gas is discharged and fresh air is taken in, whereby the striking machine is returned to the wait state shown in FIG. 1 and thus a next nailing operation is prepared.

Figure 7:
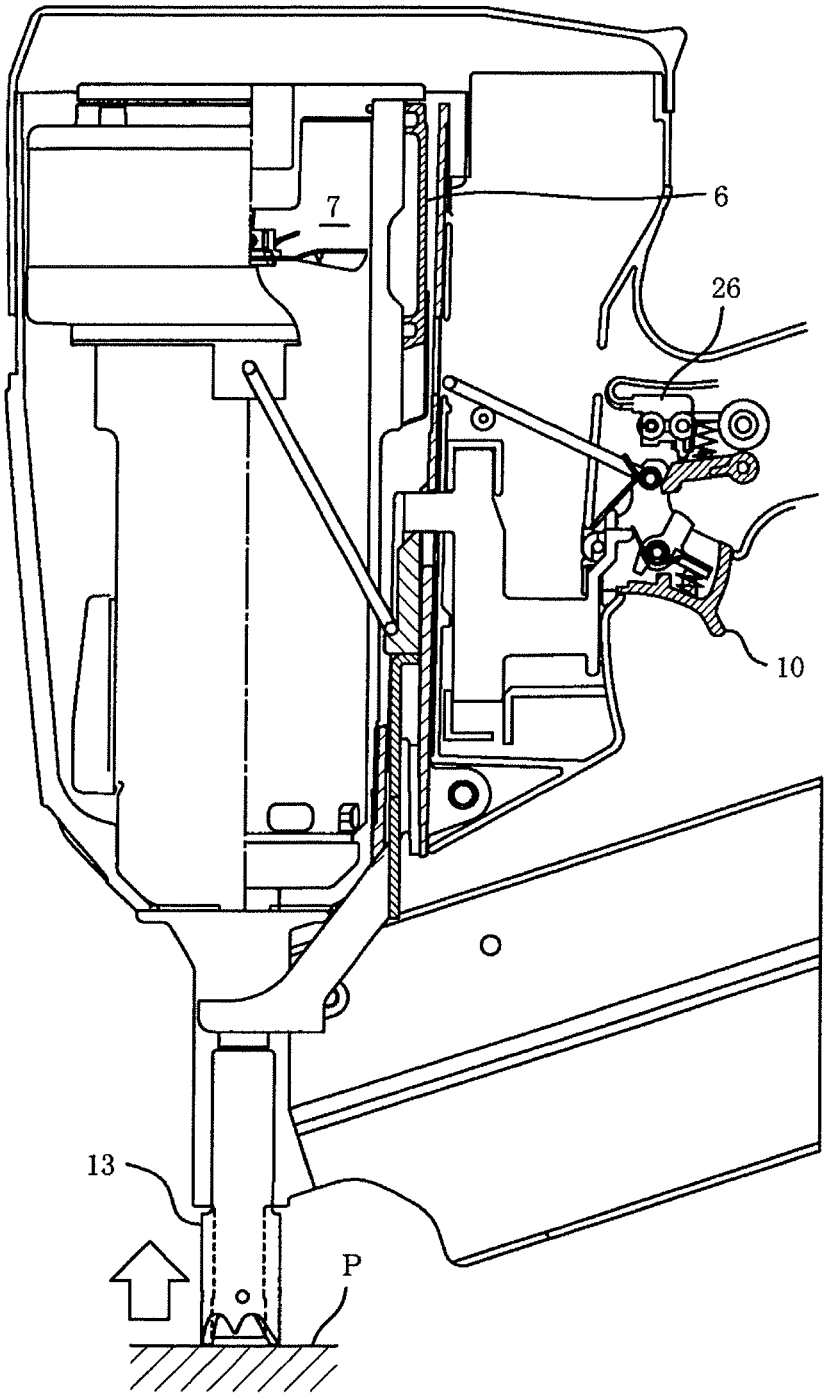
FIG. 7 is a partially longitudinal section view of the striking machine, showing a state in which the contact unit is pressed against the workpiece.
Figure 8:
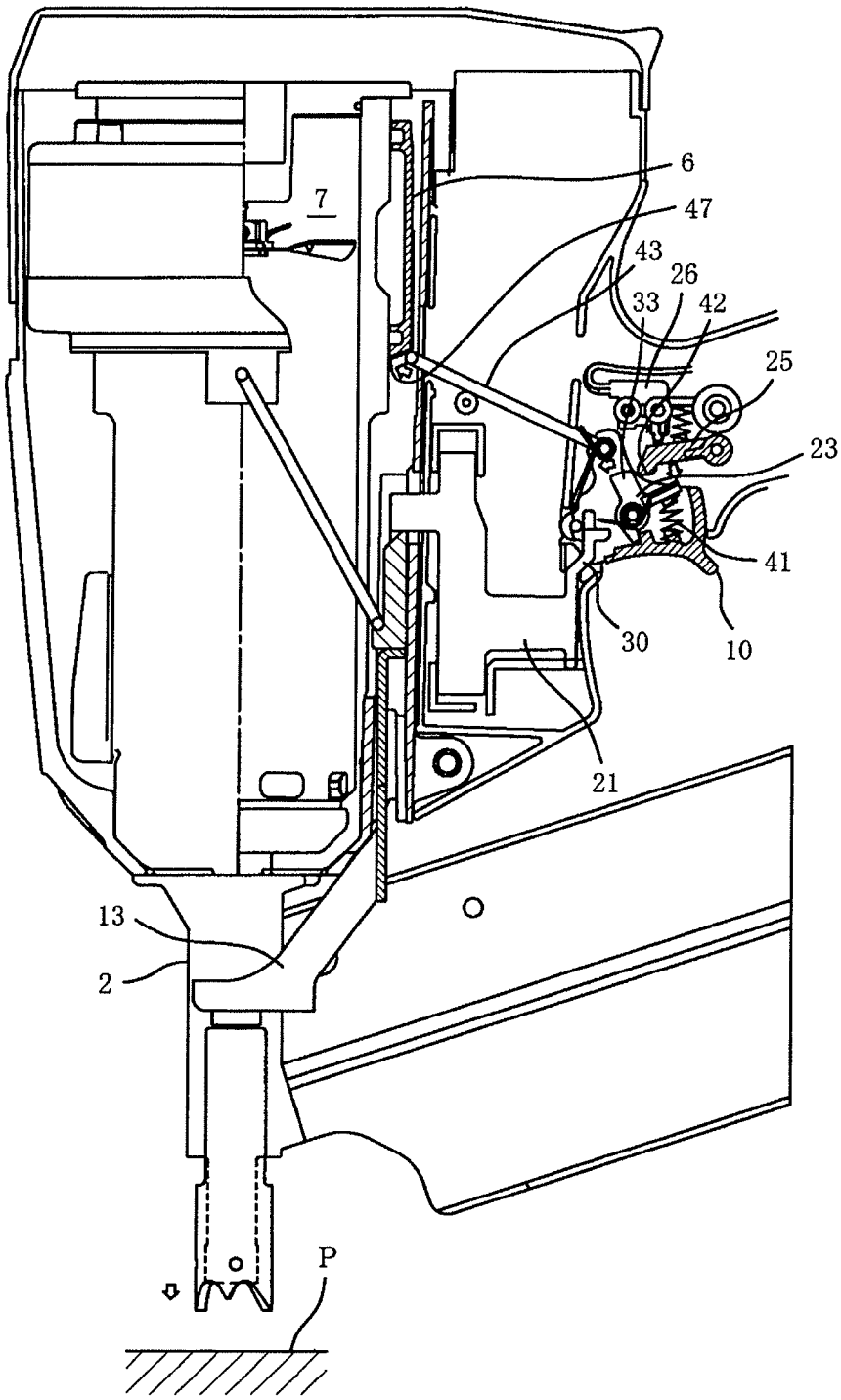
FIG. 8 is a partially longitudinal section view of the striking machine, showing a state in which the trigger is pulled to a position just before starting the operation of the striking machine to thereby hold a movable sleeve at its upper position.

Here, in the above structure, firstly, as shown in FIG. 7, while the contact arm 13 is pressed against the workpiece P, the movable sleeve 6 is moved upwardly to turn the combustion chamber 7 into a closed state. After then, in order to maintain this state, as shown in FIG. 8, the trigger 10 is pulled just before it is pressed against the microswitch 26, the lock-out bar 43 is moved downwardly of the lower surface 47 of the movable sleeve 6 and further the nose portion 2 is detached from the workpiece P. As a result of this, as described above, the movable sleeve 6 is lowered from the top dead center and the end portion of the lock-out bar 43 is engaged with the lower surface 47, thereby being able to maintain the closed state of the combustion chamber 7. However, the contact arm 13 is also moved downwardly together with the movable sleeve 6 and, at the same time, the slide arm 21 is also moved downwardly, whereby the engaging arm 30 is lowered. Due to this, the safety lever 23 loses the support of the torsion coil spring 36 and, without being pressed sufficiently against the trigger switch lever 25 by the spring force of the coil spring 41, the lever portion 33 is rotated to the left while passing the leading end 42 thereof. Therefore, even when the trigger 10 is pulled by full stroke after then, since the safety lever 23 cannot press against the trigger switch lever 25 any longer, the striking machine cannot be started. Thus, the striking machine is not able to strike a nail in the air to discharge it.

When the trigger 10 is released, the safety lever 23 returns while rotating to the right, while the movable sleeve 6 and contact arm 13 respectively lose their support and are thereby moved to their lower wait positions. At the same time, the slide arm 21 also returns to its wait position. Therefore, when the trigger 19 is pulled while the contact arm 13 is being pressed against the workpiece, a nail can be driven actually.

Figure 9:
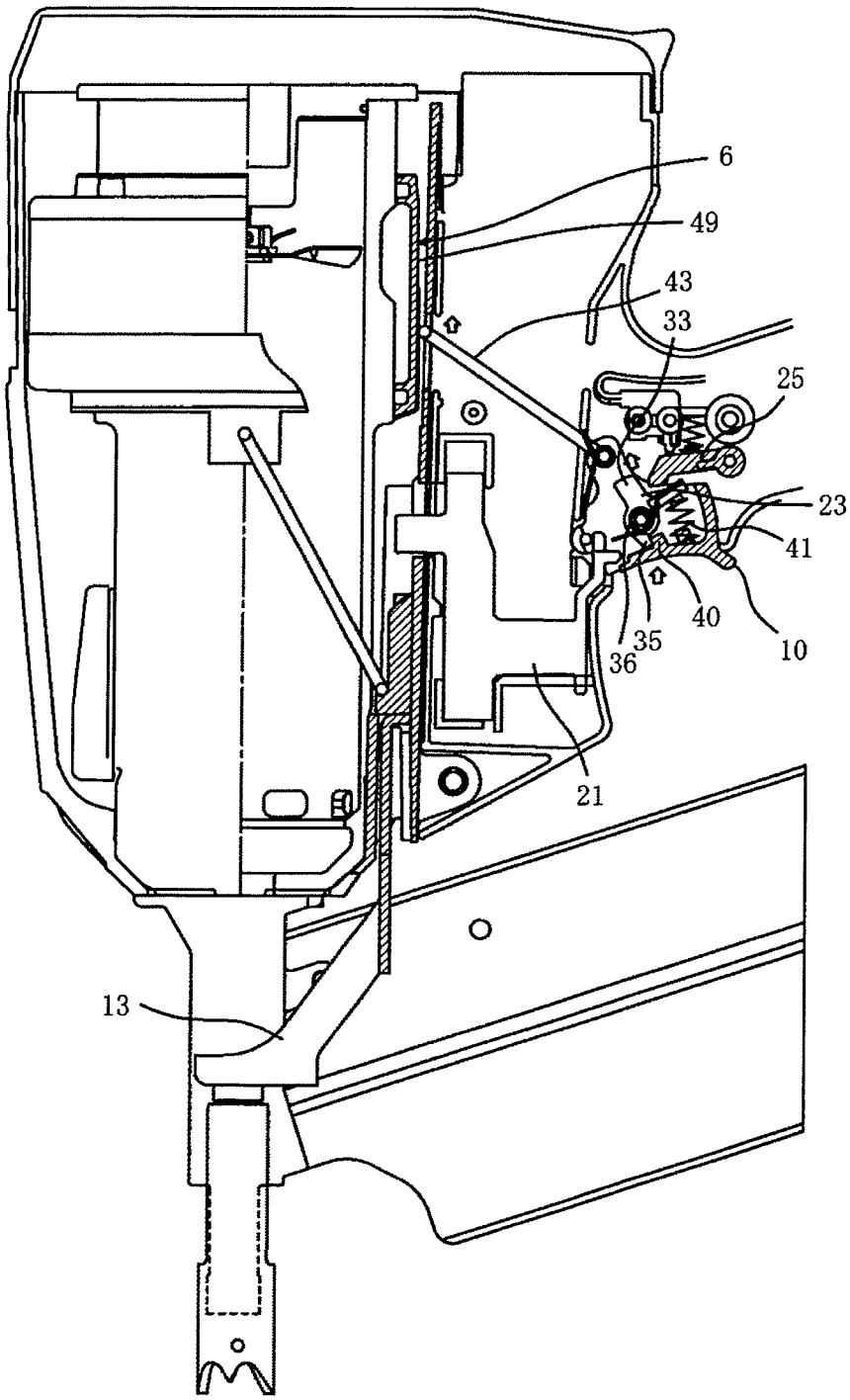
FIG. 9 is a partially longitudinal section view of the striking machine, showing a state in which the trigger is pulled first.
Figure 10:
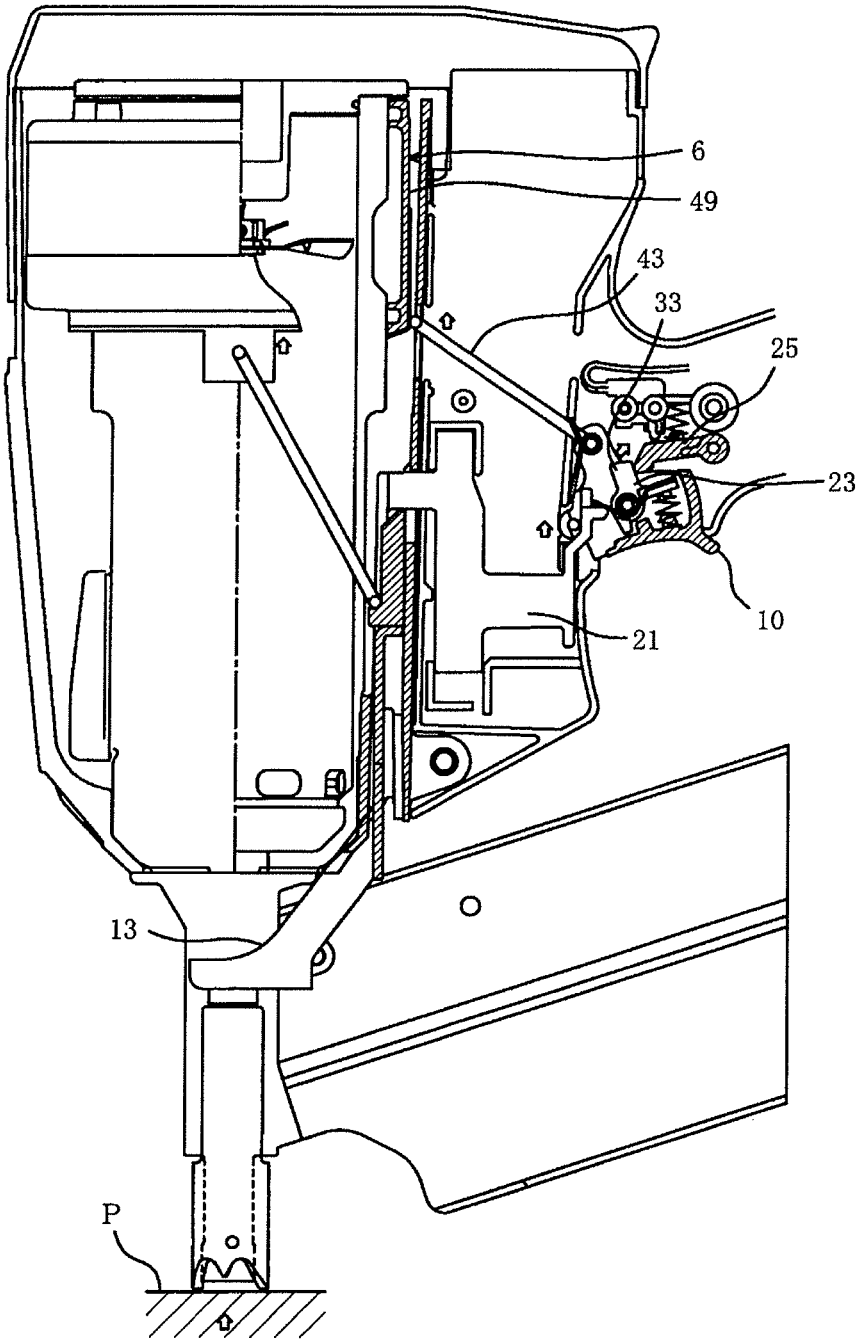
FIG. 10 is a partially longitudinal section view of the striking machine, showing a state in which a contact member is next pressed against the workpiece.

Next, in the above structure, also when the contact arm 13 is pressed against the workpiece after the trigger 10 is pulled first, the striking machine is prevented from starting. That is, as shown in FIG. 9, when the trigger 10 is pulled in a state where the contact arm 13 stands at the lower wait position, since the slide arm 21 also stays at the lower wait position, the torsion coil spring 36 does not act on the safety lever 23 but the safety lever 23 is energized to the left by the coil spring 41, while the lever portion 33 passes the leading end of the trigger switch lever 25. The engaging piece 35 is engaged with the projecting portion of the trigger 10. Also, when the trigger 10 is rotated while the movable sleeve 6 stays in the wait state in this manner, the end portion of the lock-out bar 43 is contacted with the side surface 49 of the movable sleeve 6 and is further allowed to slide up along the side surface 49. After then, as shown in FIG. 10, even when the contact arm 13 is pressed against the workpiece P, since, as described above, the safety lever 23 has passed the position for operating the trigger switch lever 25, the striking machine is prevented from starting even when the slide arm 21 is moved upwardly. In this state, since the lock-out bar 43 remains engaged with the side surface 49 of the movable sleeve 6, the movable sleeve 6 cannot be held at the upper position. That is, when the trigger 10 is operated first in this manner, the striking machine cannot be actuated.

Figure 11:
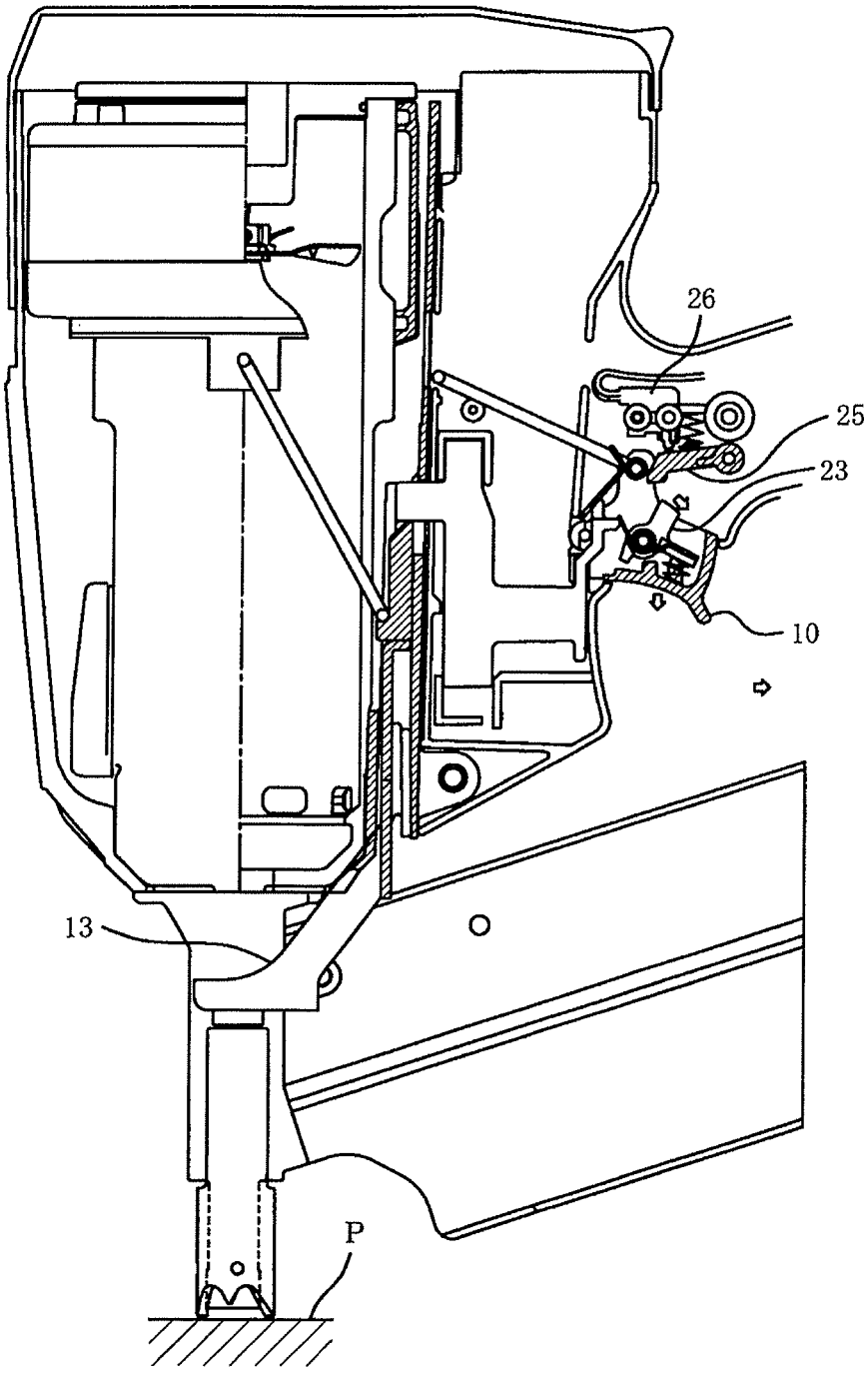
FIG. 11 is a partially longitudinal section view of the striking machine, showing a state in which the trigger is released.

In the above structure, as shown in FIG. 11, when the trigger 10 is returned to the wait state and the safety lever 23 is rotated to the right and is thereby returned to the wait position, firstly, the contact arm 13 is pressed against the workpiece P. Therefore, when the trigger 10 is operated again, the safety lever 23 rotates the trigger switch lever 25 to turn on the microswitch 26, whereby the striking machine can be started.

Figure 12:
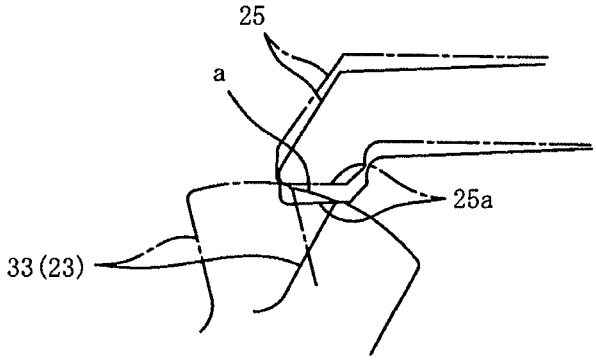
FIG. 12 is a partially longitudinal sectional explanatory view of the striking machine, showing a moving track of a safety lever and a contact area of the safety lever and a trigger switch lever.

Here, as shown in FIG. 12, the leading end of the contact arm 13 is pressed against the workpiece and then, by operating the trigger 10, the leading end edge of the lever portion 33 of the safety lever 23 is engaged with the lower surface 25*a* of the trigger switch lever 25. After then, when the safety lever 23 is moved upwardly, it is pressed against the microswitch 26 to turn it on. When the leading end edge of the lever portion 33 moves from a contact point, at which the microswitch 26 is turned on, and passes the lower surface 25*a* of the trigger switch lever 25, the microswitch 26 is turned off. A contact area a, in which the leading end edge of the lever portion 33 is moving while the leading end edge of the lever portion 33 and the lower surface 25*a* of the trigger switch lever 25 are in contact with each other, is defined as an area in which the lever portion 33 of the safety lever 23 can be contacted with the trigger switch lever 25 while, when the contact arm 13 is moved from the bottom dead center, it is moving from a substantially middle point to the top dead center. Therefore, in the case that, in a state where the contact arm 13 has moved to or higher than the substantially middle point, the trigger 10 is pulled to thereby start the operation of the striking machine, even when the timing of the machine starting operations (the time at which the trigger switch lever 25 is pulled) differ between operators, within the contact area a where the leading end edge of the lever portion 33 is moving while it is in contact with the lower surface 25*a* of the trigger switch lever 25, by pressing the microswitch 26, the driving machine can be started. Therefore, in the case that, in order to drive a nail quickly, the trigger 10 is pulled while the driving machine is pressed against the workpiece, the timing of the machine starting operation differs between the operators but, because the timing difference can be absorbed, the driving machine can be started positively.

Also, according to the above driving machine structure, since there is not used a cam which is necessary in a conventional driving machine, there is eliminated the need to pay attention to the influence of heat which is generated due to combustion of gas. Due to this, the space for storing the cam can be used effectively or such space can be saved to thereby reduce the whole height of the driving machine. And, the cost of the driving machine can also be reduced.

Also, since the lock-out bar 43 is rotatably disposed on the rotation center side of the trigger 10, there can be secured a large space in the upper portion of the trigger (a portion between the body 1 and grip 1*a*). In such space, there can be disposed a switch mechanism such as a safety lever, a switch lever, a switch and the like. This makes it possible to use the space of the upper portion of the trigger effectively and also can save a space where the conventional switch mechanism is provided. Therefore, the whole of the driving machine can be made compact.

Further, since the trigger 10 is structured such that it can move the movable sleeve 6 through the lock-out bar 43 to turn the combustion chamber 7 into a closed state, the structure of the striking machine can be simplified, the number of parts thereof can be reduced and the whole height thereof can be reduced, whereby the whole of the striking machine can be made compact. Here, when moving the movable sleeve 6 downwardly in order to open the combustion chamber 7, the lock-out bar 43 is pushed back by the movable sleeve 6 and is thereby separated from the lower surface of the movable sleeve 6. However, when the lock-out bar 43 is pushed back, the trigger 10 is also pushed back, thereby being able to reduce a spring load necessary to pull back the trigger 10 to the wait position. Therefore, the operation efficiency of the trigger 10 can also be enhanced.

Also, in the case that the trigger 10 is pulled first in order to carry out a so called contact nailing operation in which a nail is driven simply by applying the striking machine to the workpiece while the trigger 10 remains pulled, when the trigger 10 is rotated, the safety lever 23 passes the trigger switch lever 25 with no contact with it. Therefore, after then, even when the contact arm 13 is pressed against the workpiece, the striking machine is prevented against operation. Also, when the trigger 10 is rotated, the end portion of the lock-out bar 43 simply slides up along the side surface of the movable sleeve 6 (see FIG. 10). Therefore, even when an operator operates the trigger 10 while gripping it strongly, or even when the operator strikes in error the leading end of the striking machine against the workpiece strongly, no load is applied to the lock-out bar 43 or trigger 10, thereby being able to prevent them against deformation or damage. This makes it possible to protect the parts of the striking machine properly.

Figure 13B:
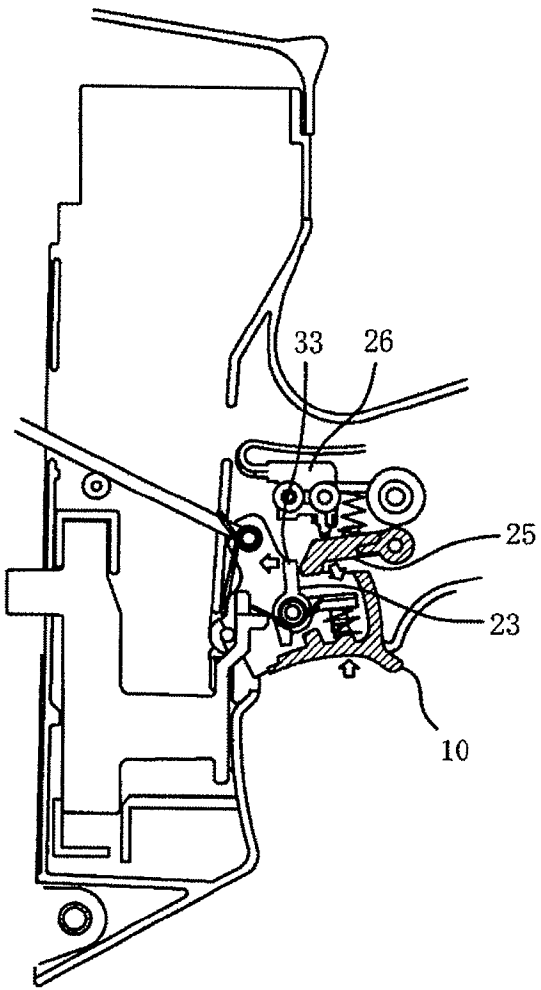
FIGS. 13(A) and 13(B) are respectively explanatory view of operating modes of the safety lever respectively corresponding to the operation of the trigger.
Figure 13A:
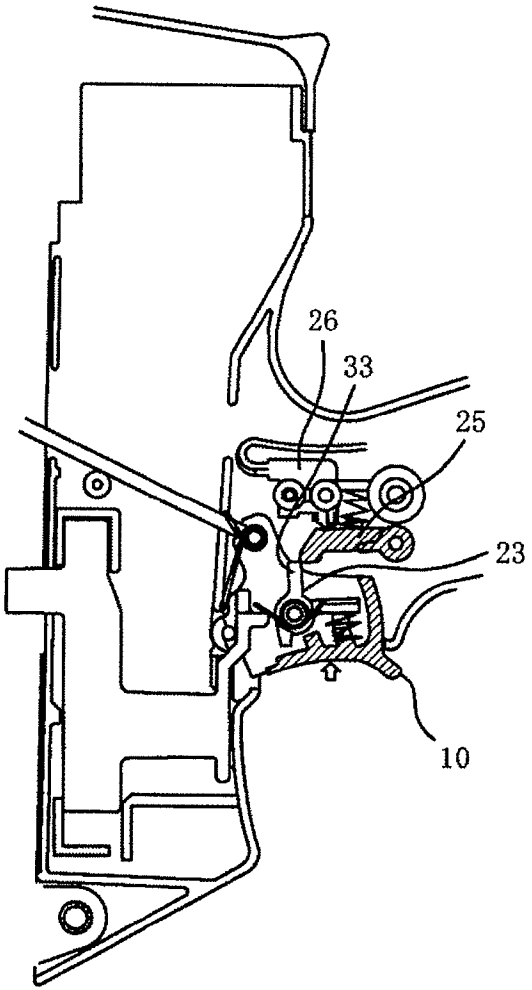

Also, although shown in FIG. 6 as well, as shown in FIG. 13(A), halfway in the rotation movement of the trigger 10 when carrying out the nailing operation, the safety lever 23 is engaged with the trigger switch lever 25 to allow it to press against the microswitch 26. After then, as shown in FIG. 13(B), when the trigger 10 is rotated at full stroke up to the rotation end thereof, the lever portion 33 of the safety lever 23 passes the trigger switch lever 25 to thereby remove its engagement with the trigger switch lever 25. Due to this structure, it is possible to positively prevent the damage and thus breakdown of the microswitch 26 which is caused due to the over-depressing of the microswitch 26. Here, when the trigger 10 is returned, the safety lever 23 lowers while rotating and, halfway in the lowering movement, the safety lever 23 is engaged with the leading end of the trigger switch lever 25. However, since the safety lever 23 does not act on the trigger switch lever 25 in such a manner that it moves the trigger switch lever 25 upwardly, the trigger 10 can be returned to the wait state. Thus, since the microswitch 26 is pressed only when the trigger 10 is pulled first, the trigger 10 is effective also when it is used as a safety device.

Figure 14:
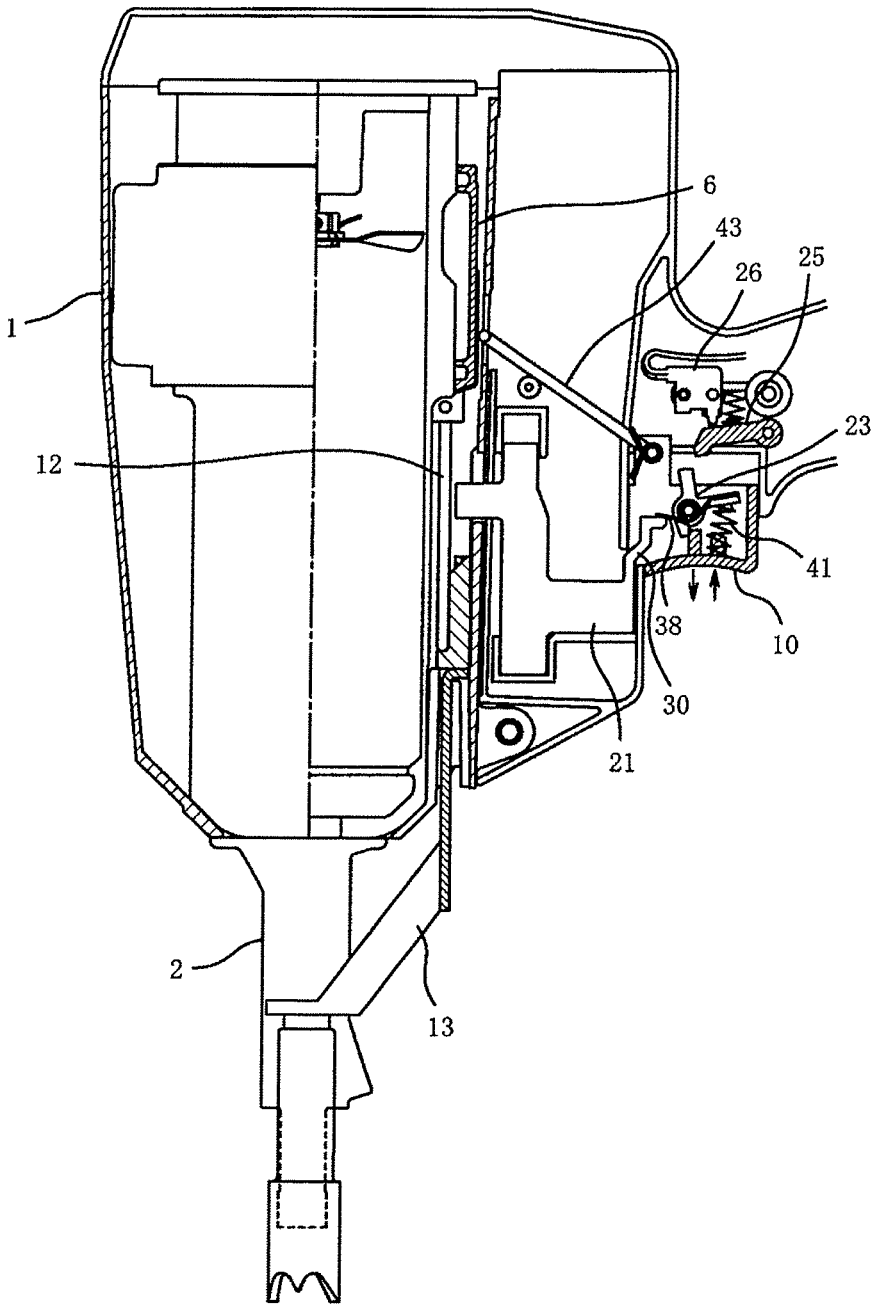
FIG. 14 is a longitudinal section view of main portions of a gas combustion type striking machine where a slide type trigger is adopted (according to a modification of the first exemplary embodiment).

Here, since the above-mentioned trigger 10 is rotatably supported on the shaft 32 on the body 1 side, there is no possibility that the sliding surface of the trigger 19 can be damaged by dust or sand generated in a working site to slow the movement of the trigger 10 and also that the parts of the trigger 10 can be worn. Therefore, the performance of the trigger 10 is hard to deteriorate and there is no need to add a wear-preventive part. However, since the trigger 10 fulfills the above-mentioned functions through its vertical movement between the slide arm 21 and trigger switch lever 25, the trigger 10 is not limited to the type that, as in the first exemplary embodiment, the trigger can be moved vertically due to the rotational movement thereof. For example, like a trigger 10 as shown in FIG. 14, according to a modification, there may also be employed a structure of a slide type that the trigger 10 can be slid vertically. In this case as well, the slide-type trigger 10 operates substantially similarly to the first exemplary embodiment and thus the description thereof is omitted here.

Second Exemplary Embodiment

Figure 15:
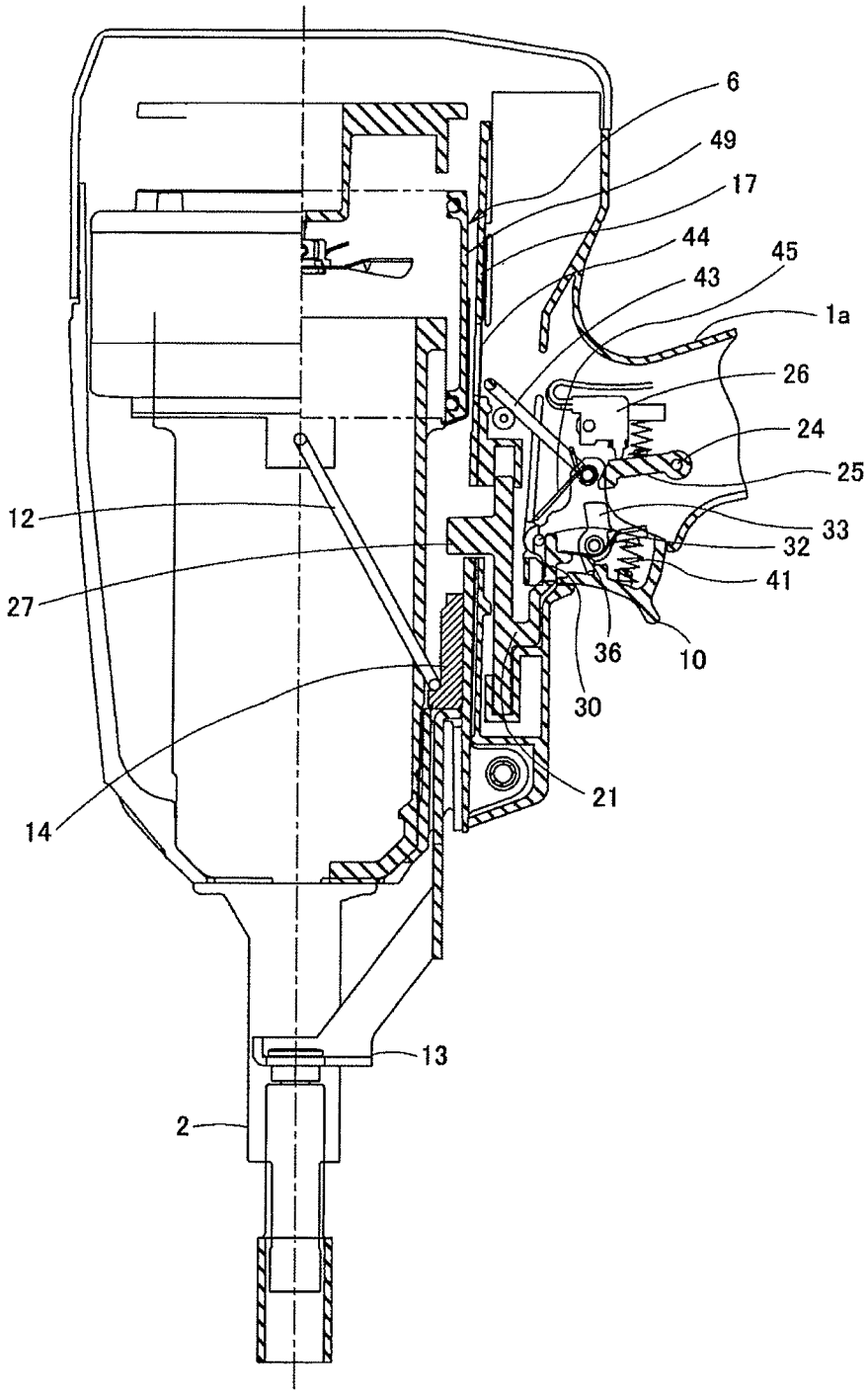
FIG. 15 is a partially longitudinal section view of a striking machine according to a second exemplary embodiment.

FIG. 15 shows a second exemplary embodiment in which a switch mechanism is disposed near a cylinder. This embodiment is substantially the same in the basic structure as the first exemplary embodiment and thus parts used in common are given the same designations.

Figure 16:
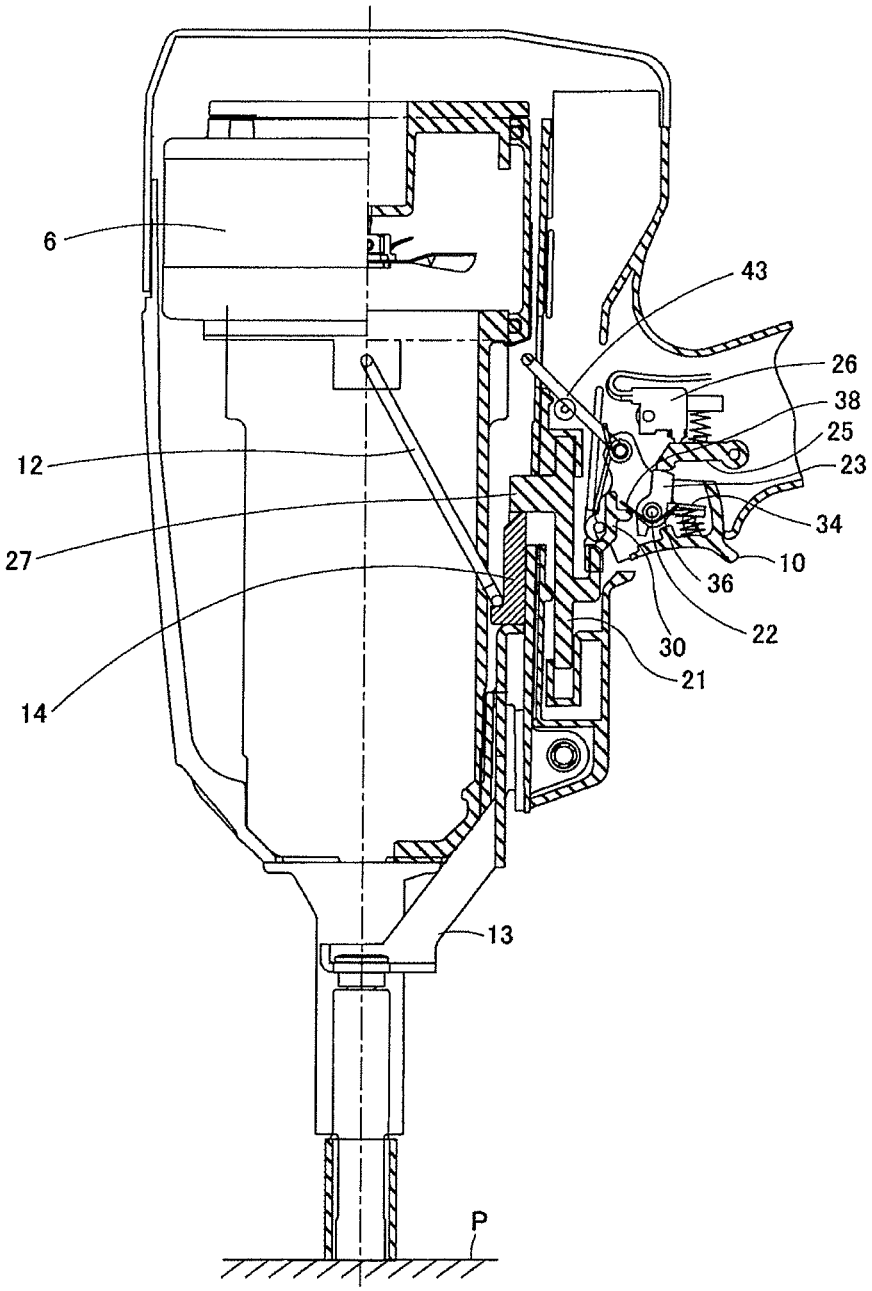
FIG. 16 is a partially longitudinal section view of the striking machine shown in FIG. 15, showing a state in which the operation of the striking machine is started for nail driving.

In the present embodiment as well, when driving a nail, firstly, as shown in FIG. 16, the lower end of the contact arm 13 is pressed against the workpiece P. Since the chamber arm 12 is also moved together with the contact arm 13 relatively to the nose portion 2, the movable sleeve 6 is pushed up, the closed combustion chamber 7 is formed, and combustible gas injected into the combustion chamber 7 is stirred and mixed with the air normally existing within the combustion chamber 7. At the same time, the guide block 14 is engaged with the slide arm 21 to thereby move it upwardly, and the engaging arm 30 pushes up one end of the torsion coil spring 36, thereby causing the safety lever 23 to rotate. In this state, when the trigger 10 is pulled up, just before the rotation end of the trigger, the leading end of the lever portion 33 of the safety lever 23 pushes up the trigger switch lever 25 to thereby turn on the microswitch 26. As a result of this, the nail is struck out.

When the nail driving operation is completed, the temperature within the combustion chamber 7 lowers suddenly, whereby the piston 5 is returned to the top dead center due to a difference in pressure between a space existing upwardly of the piston 5 and the air existing downwardly of the piston 5. And, the striking machine is pulled up to separate the nose portion 2 from the workpiece, and the trigger 10 is released and rotated downwardly, whereby the striking machine returns to the wait state and a next nailing operation is prepared.

Figure 17:
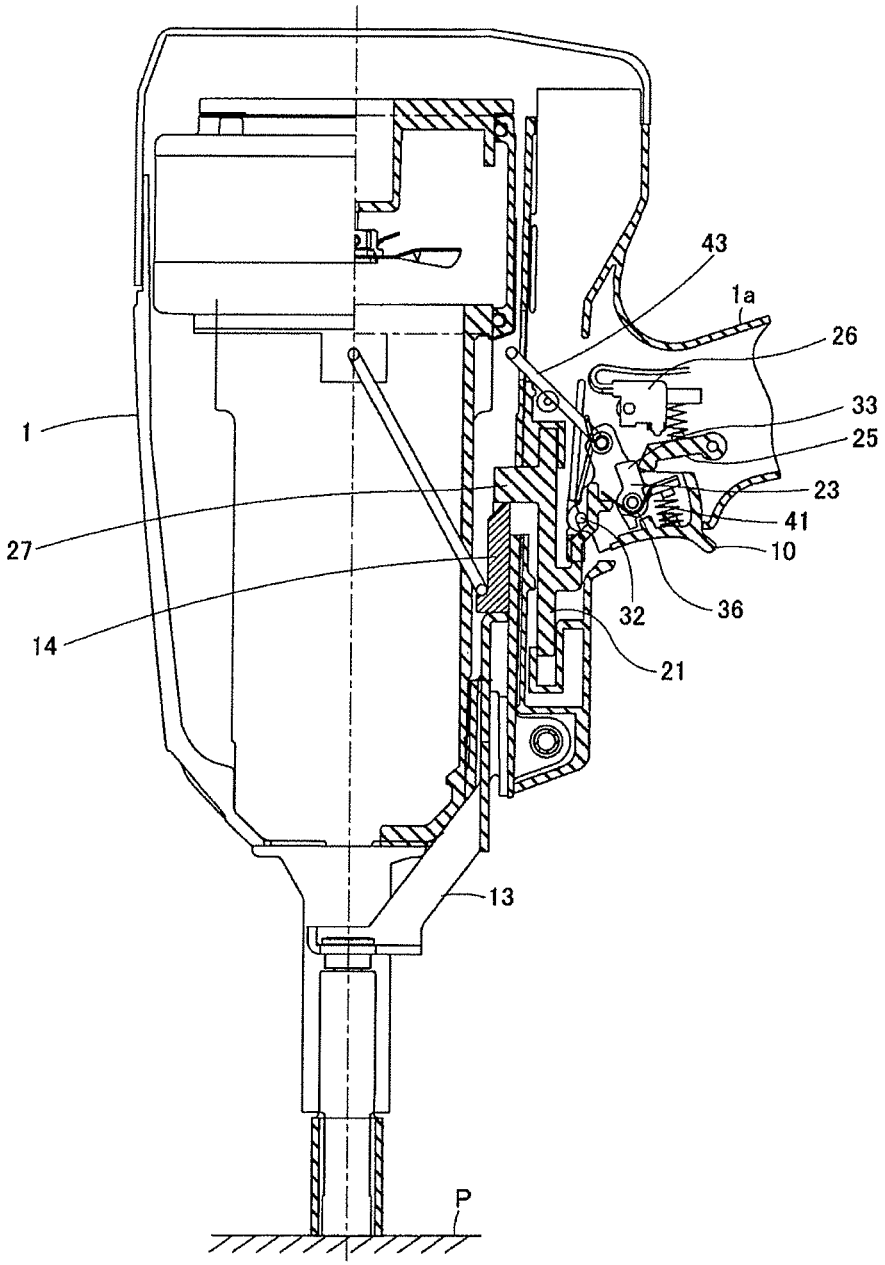
FIG. 17 is a partially longitudinal section view of the striking machine shown in FIG. 15, showing the state thereof in which the trigger is pulled first.

Next, in the above structure, as shown in FIG. 17, after the trigger 10 is pulled first, even when the contact arm 13 is pressed against the workpiece, the striking machine is prevented against operation. That is, when the trigger 10 is pulled with the contact arm 13 standing at the lower wait position, since the slide arm 21 also stands at the lower position, the torsion coil spring 36 is prevented from acting on the safety lever 23, but the safety lever 23 is energized to the left by the coil spring 41, whereby the lever portion 33 passes the leading end of the trigger switch lever 25. Therefore, after then, even when the slide arm 21 is moved upwardly by pressing the contact arm 13 against the workpiece P, the striking machine is prevented against actuation. In this manner, when the trigger 10 is operated first, the striking machine cannot be started. Therefore, a so called contact nailing operation can also be prevented.

According to the above structure, since the lock-out bar 43 is rotatably disposed on the upper portion of the rotation center side of the trigger 10, similarly to the embodiment shown in FIG. 1, in the upper portion of the trigger 10 (between the body 1 and grip 1*a*), there is secured a large space and, in this large space, there can be disposed a switch mechanism such as a safety lever, a switch lever, a switch and the like. Thanks to this, the upper portion space of the trigger 10 can be used effectively and also a space where a conventional switch mechanism has existed can be omitted, whereby the whole of the striking machine can be made compact.

Further, since the gas can 9 is not interposed between the body 1 and grip 1*a* as shown in FIG. 1, the switch mechanism can be disposed near the cylinder. This can reduce the distance from the body and grip to the trigger, and thus the position of center of gravity of the striking machine can be got nearer the body, which can improve the weight balance of the striking machine and thus the stability and operation efficiency thereof in its nail driving operation.

Also, the trigger may have a slide type structure instead of a rotation type structure.

According to the structure of the exemplary embodiments, when driving a nail, by pressing the lower end of the contact member against the workpiece, the movable sleeve is pushed up together with the contact member, whereby there is formed a closed combustion chamber. During the upward movement of the contact member, when the trigger is operated after the safety lever is operated, the safety lever is engaged with the switch lever and presses against it, whereby the switch lever pushes the switch into operation. As a result of this, since the switch of a circuit connected to an ignition plug is turned on, the mixed gas within the combustion chamber is ignited, combusted and expanded explosively. This high-pressure combustion gas is applied to the piston to drive it impactively and, using a driver connected to the lower surface side of the piston, a nail is driven out from the nose portion into the workpiece.

Also, since the hold member is rotatably disposed on the rotation center side of the trigger, there can be secured a large space in the upper portion of the trigger and, in this space, there can be provided a switch mechanism such as a safety lever, a switch lever, a switch and the like. This makes it possible to make effective use of the space of the trigger upper portion and also to save a space where a conventional switch mechanism has been provided. Therefore, the whole of the striking machine can be made compact.

Further, since the distance between the body and trigger can be reduced and thus the position of center of gravity of the striking machine can be set nearer the body, the weight balance of the striking machine as a machine can be enhanced. This allows a user to operate the striking machine easily and also can make it harder for the user to be tired.

To the trigger, there is connected a hold member extending toward the movable sleeve; and, the leading end of the hold member, when the movable sleeve moves upward, in linking with the operation of the trigger, is engaged with the lower surface of the movable sleeve to thereby hold the combustion chamber in a closed state. According to this structure, there can be formed a combustion chamber which is closed by the trigger and hold member, the structure of the striking machine can be simplified, the number of parts thereof can be reduced, and the whole height thereof can be reduced, whereby the whole of the striking machine can be made compact. Further, when moving the movable sleeve downwardly in order to open the combustion chamber, the hold member is pushed back by the movable sleeve and is separated from the lower surface of the movable sleeve; and, specifically, since, when the hold member is pushed back, the trigger is also returned, there can be reduced a spring load for returning the trigger.

In a state where the trigger is rotated halfway and the end portion of the hold member is engaged with the lower surface of the movable sleeve having lowered down to a position slightly downwardly of the top dead center to thereby hold the combustion chamber in a closed state, the slide arm movable with the lowering movement of the movable sleeve rotates the safety lever in such a manner that the leading end of the safety lever is allowed to pass the leading end of the switch lever. Therefore, after then, even when the trigger is pulled, the safety lever cannot press against the switch lever any longer, whereby the operation of the striking machine cannot be started. Thus, it is not possible to strike a nail in the air and discharge it.

When the trigger is operated while the slide arm stands at its lower position, the slide arm rotates the safety lever in such a manner that the leading end of the safety lever is allowed to pass the leading end of the switch lever. Therefore, even when the switch lever is rotated, the lever portion of the safety lever is allowed to pass the leading end of the switch lever. Thus, after then, even when the contact member is pressed against the workpiece, the striking machine will not be started. Therefore, in the case that the trigger is operated first, the operation of the striking machine cannot be started.

When the trigger is operated while the contact member stands at its top dead center, the leading end of the hold member is engaged with the side surface of the movable sleeve. Thanks to this, since, when the trigger is rotated, the end portion of the hold member simply slides up along the side surface of the movable sleeve, the end portion of the hold member does not interfere with the operation of the trigger. Therefore, even when the leading end of the striking machine is strongly struck against the workpiece in error, any load can be applied neither to the hold member nor to the trigger, which eliminates a fear that they can be deformed or damaged. Accordingly, the parts of the striking machine can be protected properly.

When the trigger is operated after the contact member is pressed against the workpiece, halfway in the operation of the trigger, the safety lever is engaged with the switch lever; and, after the switch lever is pressed against the switch, at the rotation end of the trigger, the safety lever passes the switch lever and parts away from it. Thanks to this structure, the damage and thus failure of the switch due to the over-pressing thereof can be positively prevented.

Such contact area of the contact portions of the safety lever and switch lever as ranging from a switch-on state generated when the trigger is operated after the contact member is pressed against the workpiece to thereby press the safety lever against the switch lever to a switch-off state generated when the safety lever passes the switch lever is set to correspond to the time during which the two levers are in contact with each other while the contact arm is moving from substantially the middle position to the top dead center. Thanks to this, when the trigger is pulled for actuation of the striking machine in a state where the contact arm has moved upward to or higher than substantially at the middle position, even if the timing for actuation of the machine varies according to operators, during the contact area where the safety lever and switch lever are moving in contact, by pressing the microswitch, the striking machine can be actuated positively.

The trigger is rotatably supported on a shaft on the body side. Due to this, when compared with a slide type structure, there is no possibility that the sliding surface of the trigger can be damaged by dust or sand generated in a working site to thereby slow the movement of the trigger 10, and also that the parts of the trigger can be worn. Therefore, the performance of the trigger is hard to deteriorate and there is no need to add a wear-preventive part.

DESCRIPTION OF REFERENCE NUMERALS AND SIGNS

1: Body
2: Nose portion
4: Cylinder
5: Piston
6: Movable sleeve
10: Trigger
13: Contact member
21: Slide arm
23: Safety lever
25: Trigger switch lever
26: Microswitch
43: Lock-out bar

What is claimed is:

1. A gas combustion type striking machine comprising:

a body;

a cylinder arranged in the body;

a piston arranged slidably in a vertical direction in the cylinder;

a movable sleeve arranged in an upper portion of the cylinder;

a combustion chamber which is opened and closed by moving the movable sleeve in the vertical direction;

a nose portion arranged in a lower side of the body and from which a nail is driven out;

a contact member projecting from the nose portion to be slidable in the vertical direction and configured to upwardly move with respect to the body by being pressed against a workpiece so as to move the movable sleeve in a closing direction to close the combustion chamber;

a trigger;

a safety lever pivotally supported on a shaft fixed on the trigger and arranged to be moveably linked to the movement of the contact member via a torsion coil spring supported on the shaft fixed on the trigger, wherein the safety lever is configured to be engaged with the trigger directly;

a switch lever arranged to be engageable with the safety lever;

a switch disposed above the trigger and configured to be switched by being pressed by the switch lever; and a hold member rotatably connected to the trigger and arranged to be engageable with the movable sleeve.

2. The gas combustion type striking machine according to claim 1, wherein the safety lever is rotatable between a first position and a second position with respect to the trigger, wherein the switch lever is pivotally supported on a shaft fixed on the body and rotatable between an ON position where the switch is switched on and an OFF position where the switch is switched off, and wherein the switch is fixed on the body, wherein the hold member has a base end pivotally supported on a shaft fixed on the trigger and a leading end which is engageable with the movable sleeve, and an intermediate portion of the hold member between the base end and the leading end is supported on a projecting shaft fixed on the body, and wherein the shaft supporting the base end positions between the shaft supporting the switch lever and the cylinder in a right-left direction which is perpendicular to the vertical direction.

3. The gas combustion type striking machine according to claim 2, wherein the leading end of the hold member is arranged in a position to engage with a lower surface of the movable sleeve so as to hold the combustion chamber in a closed state, in a condition that the movable sleeve is in an upper position to close the combustion chamber and that the trigger is pulled.

4. The gas combustion type striking machine according to claim 3, wherein the leading end of the hold member is arranged in a position to engage with a side surface of the movable sleeve in a condition that the contact member is in its bottom dead center and the trigger is pulled.

5. The gas combustion type striking machine according to claim 2, further comprising:

a slide arm arranged to be slidable in the vertical direction with respect to the body, wherein an engaging piece formed on a front side of the slide arm and positioned in an upper side of an upper portion of the contact member, wherein one end of the torsion coil spring is attached to a spring receiving piece formed on the safety lever, and the other end of the torsion coil spring is arranged to be engageable with an upper end of an engaging arm formed on a rear portion of the slide arm, wherein the safety lever is urged toward the first position by a spring, wherein the engaging piece of the slide arm is arranged in a position to engage with the upper portion of the contact member so as to upwardly move the slide arm, in a condition that the contact member is pressed against the workpiece and upwardly moves, wherein the other end of the torsion coil spring is arranged in a position to engage with the upper end of the engaging arm so as to rotate the safety lever toward the second position, in condition that the slide arm upwardly moves, and wherein a lever portion formed on the safety lever is arranged in a position to engage with the switch lever so as to rotate the switch lever from the OFF position to the ON position in a condition that the safety lever is in the second position and that the trigger is pulled, and not to engage with the switch lever in a condition that the safety lever is in a first position and that the trigger is pulled.

6. The gas combustion type striking machine according to claim 5, wherein the engaging arm of the slide arm is arranged in a position to make the other end of the torsion coil spring to downwardly move so as to rotate the safety lever toward the first position by the spring without an engagement of the lever portion of the safety lever with the switch lever, in a condition that the leading end of the hold member engages with the lower surface of the movable sleeve to hold the closed state of the combustion chamber and that a pressing action of the contact member against the workpiece is released to make the slide arm downwardly move with respect to the body.

7. The gas combustion type striking machine according to claim 5, wherein the lever portion of the safety lever is arranged in a position to passes the switch lever to release an engagement between the lever portion and the switch lever, in a condition that the switch lever presses the switch to switch ON by an pulling operation of the trigger and that the trigger is further pulled thereafter.

8. The gas combustion type striking machine according to claim 7, wherein a contact area in which the safety lever and switch lever are in contact with each other as ranging from a switch-on state generated when the trigger is operated after the contact member is pressed against the workpiece to thereby press the safety lever against the switch lever to a switch-off state generated when the safety lever passes the switch lever is set to correspond to a length in which the safety lever and switch lever are in contact with each other while the contact arm is moving from its substantially middle position to its top dead center.

9. The gas combustion type striking machine according to claim 1, wherein the trigger is pivotally supported on a shaft fixed on the body.

10. The gas combustion type striking machine according to claim 1, wherein a lever portion and a spring receiving piece are respectively formed to radially extend on the safety lever.

* * * * *